United States Patent [19]

Blaese

[11] Patent Number: 5,027,128

[45] Date of Patent: Jun. 25, 1991

[54] INSIDE WINDOW ANTENNA

[76] Inventor: Herbert R. Blaese, 3314 Olcott Ave., Chicago, Ill. 60634

[21] Appl. No.: 466,759

[22] Filed: Jan. 18, 1990

[51] Int. Cl.[5] ..... H01Q 1/320; H01Q 9/160

[52] U.S. Cl. ..... 343/713; 343/822; 343/878

[58] Field of Search ..... 343/711, 713, 714, 715, 343/793, 802, 820–822, 747, 752, 878

[56] References Cited

U.S. PATENT DOCUMENTS

| | | | |
|---|---|---|---|
| 2,563,243 | 8/1951 | Hills | 343/747 |
| 2,636,122 | 4/1953 | Hayes | 343/747 |
| 2,881,430 | 4/1959 | Bird | 343/747 |
| 3,339,205 | 8/1967 | Smitka | 343/747 |
| 3,832,714 | 8/1974 | Cleminson et al. | 343/713 |
| 4,238,799 | 12/1980 | Parfitt | 343/715 |
| 4,254,422 | 3/1981 | Kloepher | 343/792 |
| 4,764,773 | 8/1988 | Larsen et al. | 343/715 |
| 4,794,319 | 12/1988 | Shimazaki | 343/711 |

FOREIGN PATENT DOCUMENTS

| | | | |
|---|---|---|---|
| 3234248 | 4/1984 | Fed. Rep. of Germany . | |
| 3905421 | 9/1989 | Fed. Rep. of Germany . | |
| 0023242 | 2/1977 | Japan | 343/878 |

*Primary Examiner*—Michael C. Wimer
*Assistant Examiner*—Peter Toby Brown
*Attorney, Agent, or Firm*—Gerstman & Ellis, Ltd.

[57] ABSTRACT

An inside window antenna is disclosed having a housing adapted for mounting on an inside window, a dipole mounted within the housing with the opposed dipole ends extending out of the housing, and an electrical cable having a main conductor and a ground conductor. The main conductor is connected to a first location on the dipole, the ground conductor is connected to a second location on the dipole, and means are carried by the housing for mounting the housing on the window.

4 Claims, 1 Drawing Sheet

INSIDE WINDOW ANTENNA

FIELD OF THE INVENTION

The present invention concerns a novel antenna for mounting on the inside window of a vehicle.

BACKGROUND OF THE INVENTION

The present application is related to Blaese, U.S. application Ser. No. 440,506, filed Nov. 22, 1989, now U.S. Pat. No. 4,980,695 and entitled "Inside Antenna". It is also related to Blaese, U.S. application Ser. No. 459,939, filed Jan. 2, 1990, and entitled "Window Ledge Antenna".

Remote control operation of various functions has become common. Thus, many functions relating to one's vehicle can be controlled remotely. For example, vehicles having alarm systems often require disarming prior to entry. Remote disarming of such alarm systems, using the key to the vehicle which contains a transmitter, is known. Remote starting of the vehicle from a small transmitter carried by the operator is also known. Of course, there are many other remote functions that can be achieved using a transmitter carried by the operator.

Often small transmitters used for remote control of functions within a vehicle provide a 300 to 320 mHz signal for the remote activation. It is desirable for the vehicle to have an antenna that is capable of significant reception, so that activation of the functions can be achieved remotely with a transmitter utilizing relatively little energy. To this end, I have discovered a novel window antenna for a vehicle, or for use on the window of any interior volume, which is very simple in construction, efficient to manufacture, and is excellent in its operating capabilities.

Other advantages of the present invention will become apparent as the description proceeds.

SUMMARY OF THE INvENTION

In accordance with the present invention, an inside window antenna is provided. The antenna comprises a housing adapted for mounting on an inside window. A dipole is mounted within the housing, with the opposed dipole ends extending out of the housing. In the illustrative embodiment, the dipole includes a central loading coil located within the housing.

An electrical cable is provided having a main conductor and a ground conductor. The main conductor is connected to a first location on the dipole and the ground conductor is connected to a second location on the dipole. Means are provided for mounting the housing on the window.

In the illustrative embodiment, the electrical cable extends through the housing in a direction that is generally normal to the direction of the dipole. The antenna is optimally operated as a receiving antenna at about 300 mHz and has an effective bandwidth of about 20 mHz.

In the illustrative embodiment, the housing comprises a rectilinear molded plastic member having a base portion and a receptacle portion. The loading coil is located within the receptacle portion. A plastic closure portion is provided for closing the receptacle portion. The mounting means comprises pressure sensitive adhesive carried by the closure portion.

A more detailed explanation of the invention is provided in the following description and claims, and is illustrated in the accompanying drawings.

DETAILED DESCRIPTION OF THE ILLUSTRATIVE EMBODIMENT

Figure 1:
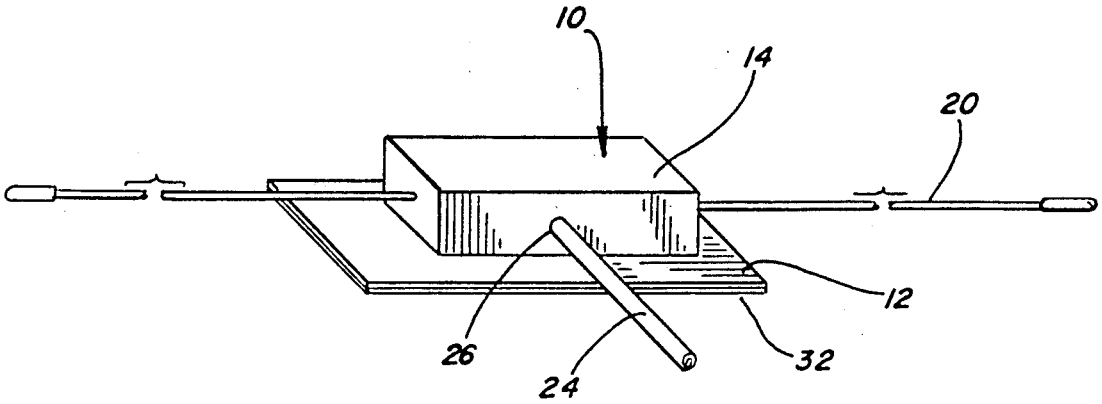
FIG. 1 is a perspective view of an inside window antenna constructed in accordance with the principles of the present invention.
Figure 2:
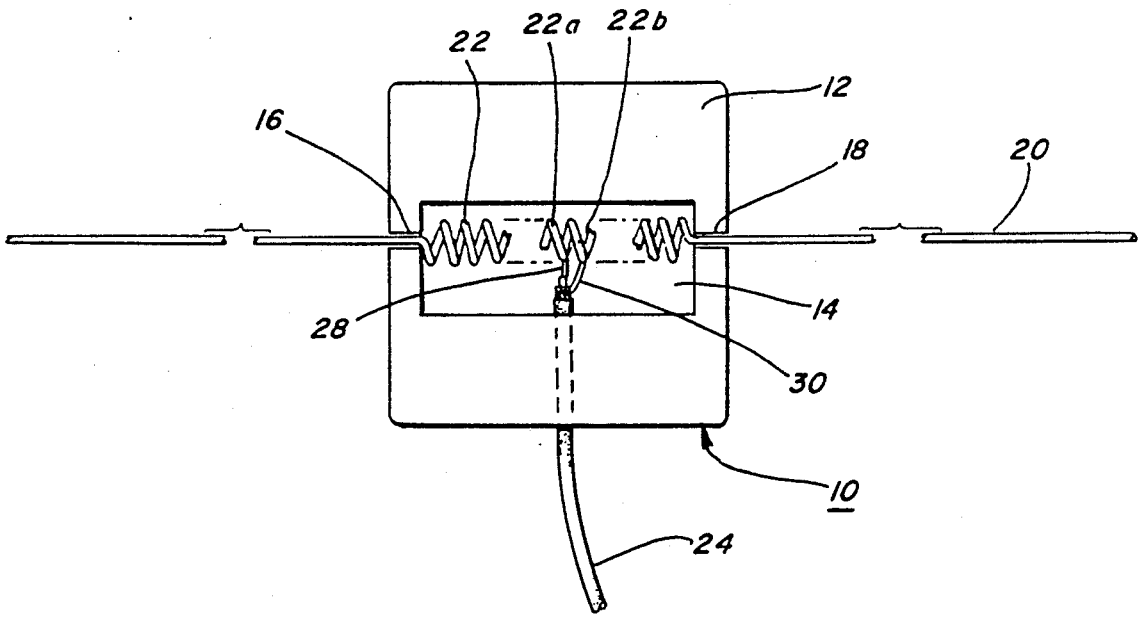
FIG. 2 is a view of the housing, open for clarity, showing the loading coil-coaxial cable connections.

An inside window antenna for mounting on the window of the vehicle is illustrated in FIGS. 1 and 2. Referring to the figures, the antenna comprises a housing 10 having a base portion 12 that is generally rectilinear, preferably square, and a generally rectilinear receptacle portion 14. Base portion 12 and receptacle portion 14 are preferably molded in plastic as a unitary member.

Base portion 14 defines slots 16,18 communicating with receptacle portion 14 for receiving a dipole 20 so that its opposed ends can extend outside of the housing 10. Dipole 20 is center fed and includes a continuous loading coil 22 which is located within receptacle portion 14. Alternatively, the dipole may comprise a pair of separated rods which are not loaded. Housing 10 and dipole 20 is structured so that the unit can be mounted on an inside window of a vehicle, for example, with dipole 20 extending horizontally, or in any suitable direction. As an example, the unit can be mounted on the window of the vehicle, behind the rear view mirror.

A coaxial cable 24 extends through an opening 26 in receptacle portion 14, with the main conductor 28 fastened by solder or suitable connecting means to one coil **22*a* and the ground conductor 30 is connected by solder or suitable fastening means to adjacent coil 22*b*. If the dipole comprises two separated rods, main conductor 28 is connected to the proximal end of one rod and ground conductor 30** is connected to the proximal end of the other rod.

The open side of receptacle portion 14 is closed by means of a plastic closure portion 32 (FIG. 1). The underside of closure portion 32, away from the receptacle portion 14 of housing 10, carries a pressure sensitive adhesive with a plastic or paper tear strip. When the strip is removed, the pressure sensitive adhesive is exposed to allow housing 10 to be mounted on the inside window.

It is preferred that the unit be structured to enable the mounting of the unit either behind the rear view mirror of a vehicle or next to the door posts. As a specific example although no limitation is intended, base 12 has dimensions of approximately 2 inches by 2 inches and the length of dipole radiator 20, from end to end, is 11.5 inches. The illustrative embodiment provides an antenna having an optimal frequency of 300 to 320 mHz, a bandwidth of 20 mHz, a nominal impedance of 50 Ohms, unity gain and maximum power of 25 watts. With the housing formed of ABS plastic and utilizing an RG 174U cable, the antenna is formed in a relatively small size, is rugged, and the radiator is such that it can easily be mounted behind the rear view mirror or parallel to the vehicle molding. The result is a receiving antenna providing superior performance and dramatically increasing range of remote transmission.

Although an illustrative embodiment of the invention has been shown and described, it is to be understood that various modifications and substitutions may be made by those skilled in the art without departing from the novel spirit and scope of the present invention.

What is claimed is:

1. An inside window antenna, which comprises:

a housing adapted for mounting on an inside facing side of a window;

a dipole formed of wire radiating elements mounted within said housing, with the opposed dipole ends extending out of the housing;

a coaxial electrical cable having a main conductor and a ground conductor;

means connecting the main conductor of said coaxial cable to a first location on the dipole;

means connecting the ground conductor of said coaxial cable to a second location on the dipole;

said housing having a rear portion that is flat for attachment of the housing to the window by adhering said rear flat portion directly to the window; and pressure-sensitive adhesive means for mounting the housing on the window.

2. An inside window antenna as defined by claim 1, in which said antenna is adapted for mounting on the window of a vehicle and said dipole is at an optimal length for receiving remote control signals having a frequency of about 300 megahertz to 320 megahertz.

3. An inside window antenna as defined by claim 1, including a removable tear strip covering said pressure sensitive adhesive means.

4. An inside window antenna as defined by claim 1, in which said dipole comprises a center-fed loaded dipole including a central loading coil located within the housing, said main conductor being connected to a first location on said coil and said ground conductor connected to a second location on said coil.

* * * * *